US005113928A

United States Patent [19]

Myers

[11] Patent Number: 5,113,928

[45] Date of Patent: May 19, 1992

[54] HEAT EXCHANGER WITH FLUID PRESSURE RELIEF MEANS

[75] Inventor: Austin R. Myers, Racine, Wis.

[73] Assignee: Thermal Transfer Products, Ltd., Racine, Wash.

[21] Appl. No.: 440,906

[22] Filed: Nov. 22, 1989

Related U.S. Application Data

[63] Continuation-in-part of Ser. No. 377,257, Jul. 10, 1989, abandoned.

[51] Int. Cl.[5] ..... F28F 27/00; F28F 27/02; F28F 9/22

[52] U.S. Cl. ..... 165/38; 165/103; 165/159

[58] Field of Search ..... 165/34, 35, 38, 40, 165/96, 103, 159, 161

[56] References Cited

U.S. PATENT DOCUMENTS

| | | | |
|---|---|---|---|
| 1,904,875 | 4/1933 | Metzgar | 165/159 |
| 2,469,315 | 5/1949 | Shaw | 165/38 |
| 2,469,316 | 5/1949 | Shaw | 165/38 |
| 3,990,504 | 11/1976 | Kolthoff, Jr. | 165/40 |
| 4,475,588 | 10/1984 | Tsou | 165/159 |
| 4,589,478 | 5/1986 | Wunder | 165/76 |
| 4,642,149 | 2/1987 | Harper | 165/160 |

FOREIGN PATENT DOCUMENTS

| | | | |
|---|---|---|---|
| 305052 | 2/1916 | Fed. Rep. of Germany | 165/38 |
| 1776089 | 9/1971 | Fed. Rep. of Germany . | |
| 846300 | 9/1939 | France | 165/40 |
| 0205741 | 1/1984 | German Democratic Rep. | 165/159 |
| 0197996 | 9/1986 | Japan | 165/159 |
| 200962 | 8/1967 | U.S.S.R. | 165/159 |
| 1002792 | 3/1983 | U.S.S.R. | 165/159 |
| 310157 | 4/1929 | United Kingdom | 165/103 |
| 325697 | 2/1930 | United Kingdom | 165/103 |
| 343600 | 2/1931 | United Kingdom | 165/103 |
| 392748 | 10/1932 | United Kingdom | 165/103 |
| 460047 | 1/1937 | United Kingdom | 165/38 |
| 620097 | 3/1949 | United Kingdom | 165/35 |

*Primary Examiner*—John K. Ford
*Attorney, Agent, or Firm*—Arthur J. Hansmann

[57] ABSTRACT

A heat exchanger with internal fluid pressure relief means [33,54], and including an exchanger body [14] and a bundle of tubes [11] disposed therein. A baffle [23,46] directs liquid flow over the tubes and around the baffle at one end [26,48] spaced from the exchanger body. A spring-loaded portion [33,54] of the baffle permits relief of excessive liquid pressure applicable to the tubes.

19 Claims, 2 Drawing Sheets

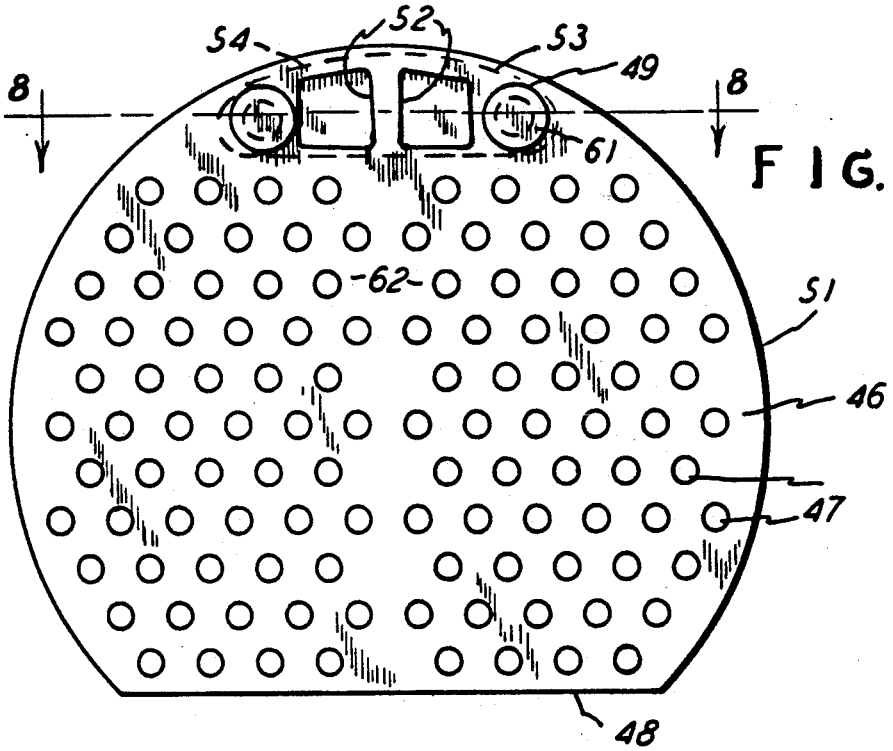
FIG. 7
FIG. 9
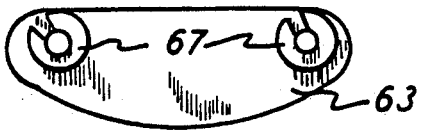
FIG. 10
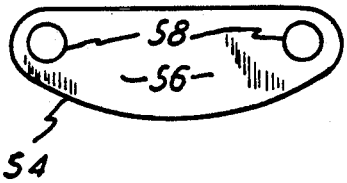
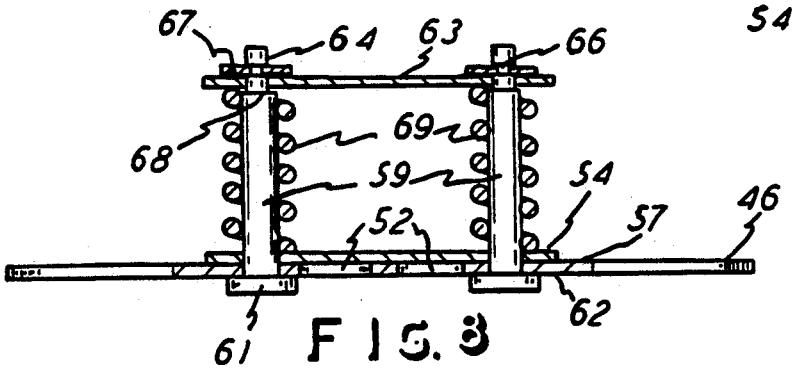
FIG. 8

HEAT EXCHANGER WITH FLUID PRESSURE RELIEF MEANS

This application is a continuation-in-part of application Ser. No. 377,257, filed Jul. 10, 1989 now abandoned.

This invention relates to a heat exchanger with fluid pressure relief means, and, more particularly, it relates to a shell and tube type of heat exchanger with a baffle disposed therein for directing the flow of liquid over the tubes and with a spring-type relief means for relieving excessive liquid pressure.

BACKGROUND OF THE INVENTION

Shell and tube-type of heat exchangers with baffles therein are commonly known in the art and of course are known and understood by those skilled in the art. An example of this type of heat exchanger is found in U.S. Pat. No. 1,904,875 wherein there is a shell with a liquid inlet and a liquid outlet and with baffles disposed therein for creating a serpentine flow path of the liquid through the shell and across the tubes disposed within the shell. In that instance, the baffle or baffles are arranged to have one edge spaced from the shell so that the liquid is permitted to flow through the space and thereby be directed across the tubes for optimum heat exchange.

Further, when liquid pressure is increased, or at some maximum amount, within the shell, then the prior art exchangers utilize spring-type liquid-pressure relief arrangements so that the liquid under excessive pressure will not flow into the interior of the shell and the arrangement thereby minimizes the liquid pressure flowing to the shell. An example of that type of external but spring-loaded relief means is shown in U.S. Pat. No. 4,642,149. However, in that example, it is necessary that the relief means be provided in an elaborate arrangement and external of the exchanger itself. As such, it requires external liquid connecting lines and it requires the relief valve or connector itself, and thus additional apparatus and provision for same are required.

The present invention improves upon the prior art by avoiding the need for external pressure relief apparatus, and thereby avoiding the need for the additional connectors, lines, and a special valve itself. Accordingly, the present invention provides for liquid-pressure relief means in the interior of the shell and arranged directly in connection with the baffle disposed within the shell. As such, the present invention provides for a simplified, improved, and inexpensive relief means which rapidly and accurately permits relief of the internal liquid pressure and which also efficiently re-establishes normal flow of the liquid around the spaced end of the baffle, as desired and when the liquid pressure is reduced from the excessive amount which activated the relief function.

The present invention thereby provides for an automatically adjusting relief mechanism which reacts in accordance with the liquid pressure within the shell and which provides for the simplified and accurate provision of a relief mechanism which is completely incorporated in the baffle itself. The relief mechanism of this invention thereby protects the parts of the exchanger itself and avoids damage to the exchanger which may otherwise be damaged by virtue of high-liquid pressure. As indicated, there is therefore no need for external connectors to achieve the liquid pressure relief, and therefore a more reliable and inexpensive, but yet accurate type of relief is provided since it is incorporated in the deflector baffle itself and since it is self-recovering and is not dependent upon any valve seat in order to re-establish itself in the desired deflective mode. That is, the externally arranged by-pass or relief valves commonly incorporate a valve seat which can be inadvertently retained in open position by means of a defective valve or seat or by debris within the liquid itself.

BRIEF DESCRIPTION OF THE DRAWINGS

FIG. 7 is a face view of another embodiment of the baffle of this invention.

FIG. 8 is a sectional view taken on the line 8—8 of FIG. 7.

FIG. 9 is a top view of a partion of FIG. 8.

FIG. 10 is a face view of another part of FIG. 8.

DETAILED DESCRIPTION OF THE PREFERRED EMBODIMENTS

Figure 1:
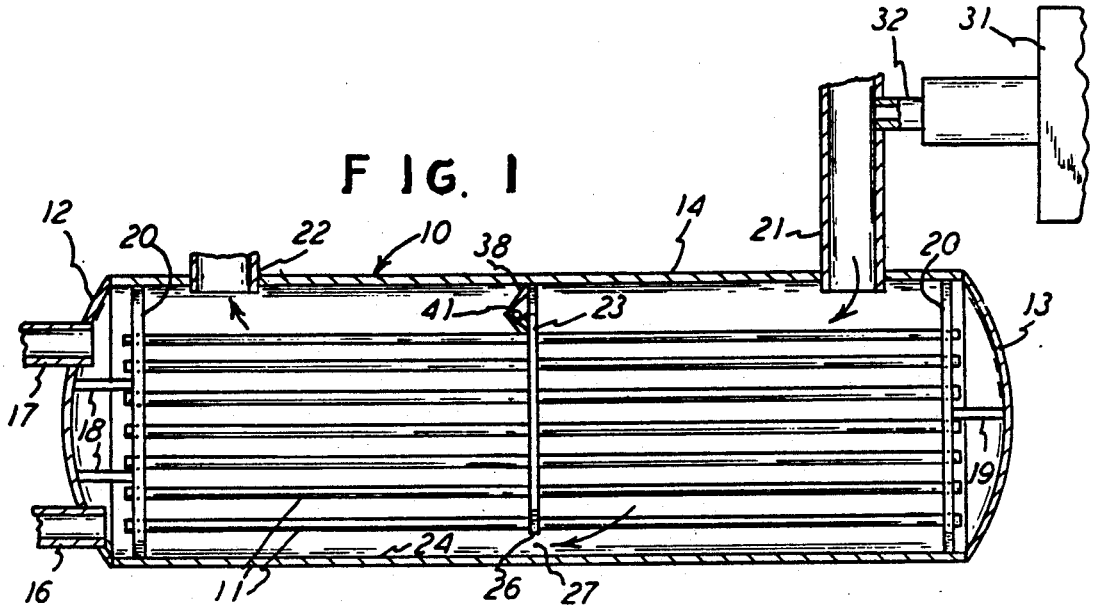
FIG. 1 is a longitudinal sectional view of a shell and tube-type of heat exchanger incorporating this invention.

FIG. 1 shows a shell and tube-type of heat exchanger which has a conventional shell 10 and a conventional bundle of tubes 11 disposed longitudinally within the elongated shell 10. As such, this arrangement is similar to that of a standard one and such as shown in U.S. Pat. No. 1,904,875 which is incorporated herein by reference thereto. The shell 10 has end caps 12 and 13 which are suitably liquid tight with the cylindrically-shaped body 14 of the shell 10. Liquid inlet and outlet pipes or connectors 16 and 17 are connected with the end cap 12 for directing fluid to the interior of the shell body 14 and through the tubes 11 in conventional sequential flow, such as through the shown lower two rows of tubes 11 and rightwardly and then into the end cap 13 and leftwardly into the next upper two rows of tubes 11 and then again rightwardly and leftwardly until the flow goes out the outlet connector 17, all in the standard arrangement. That is, there are flow dividers 18 and 19 in the end caps, respectively, for creating the flow through the hollow tubes in the pattern described above. The usual full partition 20 is also provided at each end of body 14.

The shell body 14 also has two liquid connectors being the inlet connector 21 and the outlet connector 22, and these connectors direct a liquid into the cylindrical body 14 and over the exterior of the tubes 11 for the heat exchange, all in the conventional arrangement. Also, the shell-and-tube type heat exchanger commonly has a baffle, such as the baffle shown in U.S. Pat. No. 1,904,875, for directing the liquid flow across one end of the tubes 11 and then in the other direction across another portion or end of the tubes 11. In the arrangement shown in FIG. 1, the flow would follow that shown in the arrows in FIG. 1 and go around the baffle designated 23 and out the outlet 22, in the direction of the arrows shown thereon. That is, the baffle 23 is normally liquid tight with respect to the cylindrical interior 24 of the shell body 14, except for the lower edge 26 of the baffle 23 which is shown spaced from the shell interior and thus providing a space designated 27 for the flow of the liquid around that baffle 23, in the desired flow pattern.

Figure 2:
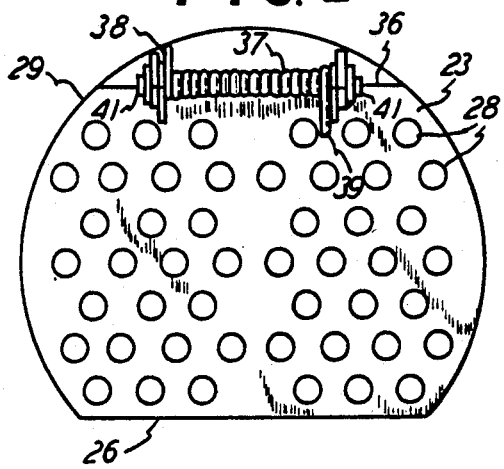
FIG. 2 is an enlarged face view of the baffle of this invention and with the pressure relief apparatus shown thereon.

In that arrangement, the tubes 11 extend through circular openings 28 in the baffle 23, and there is thus mutual structural support between the tubes 11 and the baffle 23. Also, FIG. 2 shows that the baffle 23 has a substantially circular periphery 29, except for the truncated and straight edge 26, and the circumference 29 is in contact with the body interior 24, and the edge 26 is spaced therefrom for the flow through at the space 27, as mentioned.

Also, FIG. 1 shows that there is apparatus connected to the liquid inlet 21, and this may be injection molding mechanism designated 31, and that is a type of mechanism which inherently can create a surge of high-liquid pressure in flow to the inlet 21 through the connector 32 from the injection molding or like apparatus 31. It is that surge or high-pressure creation which is eliminated or relieved by virtue of the special pressure relief of this invention and which is described hereinafter.

Figure 3:
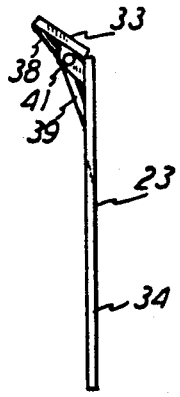
FIG. 3 is a right-side view of FIG. 2, with the relief means in the opened position.
Figure 4:
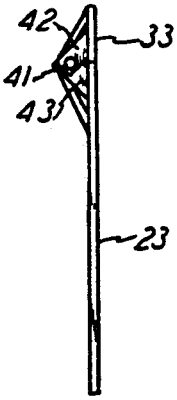
FIG. 4 is a right-side view of FIG. 2 with the relief means in the closed position as in FIG. 2.
Figure 5:
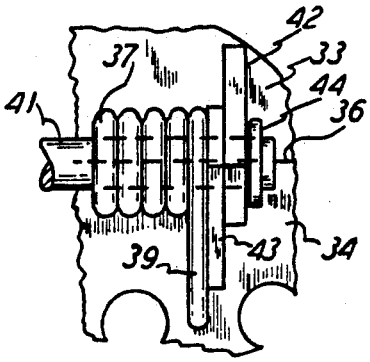
FIGS. 5 and 6 are, respectively, enlarged face and right-side views of a portion of the baffle and the relief means of this invention.

It will therefore be understood that the baffle 23 is in fluid-tight contact with the interior cylindrical wall 24 of the body 14, except for the space at 27 which is defined by the baffle straight edge 26. The baffle, whether it be a single baffle in the exchanger or a plurality of baffles, such as in U.S. Pat. No. 1,904,875, thus causes the diverted flow of the liquid transversely over the tubes 11, such as shown by the arrows in FIG. 1. However, when the liquid pressure in the body 14 is excessive, then the pressure can be relieved by means of the baffle 23 having a movable portion 33 which creates another space or flow passageway with the body interior wall 24. That is, the baffle portion 33 is shown to be hingedly mounted to the remainder of the baffle 23, and excessive fluid pressure entering through the inlet 21 will be directly applied to the portion 33 to cause it to pivot relative to the remainder of the baffle 23, as shown in FIG. 3, and thereby permit the fluid to flow directly to the outlet 22 and not be impressed upon the tubes 11 nor the remainder of the body 14, and thereby avoid damage to the exchanger.

Figure 6:
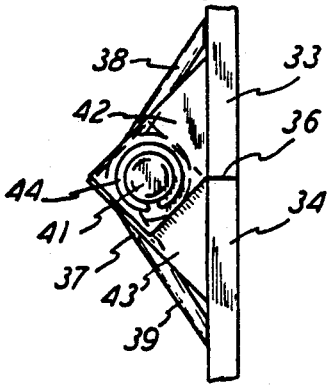

The baffle 23 therefore has a main portion 34 and the hinged portion 33, and they seat together in an aligned position along the abutting surfaces designated 36 in FIG. 6. A torsion spring 37 is applied between the baffle sections or portions 33 and 34 to yieldingly urge the hinged portion 33 into the closed or aligned position with the baffle remainder 34, as shown in all views except FIG. 3. The spring 37 has two end legs 38 and 39 which are in pressing contact with the baffle portions 33 and 34, respectively, for urging the hinged portion 33 into the closed flow or aligned position, as shown.

One arrangement for the assembly which includes the spring 37 is to provide a hinge pin 41 extending substantially the length of the mating line 36, such as shown in FIG. 2, and to support the pin 41 on arms 42 and 43 integral with and extending from the respective baffle portions 33 and 34 and having end openings for the pin 41 to extend therethrough, again as shown in FIG. 2 in full view. Thus, the pin 41 is in fixed and permanent position relative to the baffle 23, and the baffle hinged portion 33 is pivotal about the longitudinal axis of the pin 41 and is under the influence of the torsion spring 37.

The spring 37 is under tension when in the baffle closed position mentioned, and thus the baffle portion 33 will remain in closed position to resist a specified quantum of fluid pressure applied through the opening 21. Of course anything in excess of that pressure will cause the baffle portion 33 to pivot to a degree of opening and thereby relieve the pressure in accordance with the degree of opening and thus the pressure is somewhat regulated according to the strength or tension in the spring 37. In fact, the spring tension can be altered by altering the number of wraps of the spring 37 around the pin 41, and then the pin can be assembled with the support arms 42 and 43, such as by a snap ring 44 on each end of the pin 41, as shown. That is, there can be fewer or more wraps of the spring 37 around the pin 41 for either decreasing or increasing the tension in the spring 37 and thus of course increasing the pressure that the respective spring legs 38 and 39 apply against the respective portions of the baffle 23.

In this arrangement, the exchanger body 14 inlet and outlet connectors 21 and 22 are on what is called one side of the body 14, and it is on that side that the baffle hinged portion 33 is also located to thereby provide a direct flow from the inlet 21 past the baffle 23 and to the outlet 22. Therefore, the other fluid passageway relative to the baffle 23, namely at the space 27, is adjacent an end of the baffle 23, but that end of course is diametrically opposite from the location of the hinged portion 33.

Another embodiment of the invention is shown in FIGS. 7–10 where there is a baffle plate 46 which would be disposed in the shell 14 in place of the plate 23 in FIG. 1. Plate 46 is shown to have the plurality of tube holes 47, and it has the edge 48 which creates the space with the shell 14, such as the space 27 in FIG. 1.

Also, a portion of the plate 46 is generally designated 49 and is on that edge of the plate 46 diametrically opposite the straight plate edge 48. It will be understood that the general circumference 51 of the plate 46 is in liquid-tight contact with the interior 24 of the shell 14. Of course the tubes extend through the baffle 46 while being disposed in the plurality of tube holes 47.

FIG. 7 also shows that the plate 46 has two openings or fluid passageways 52 extending therethrough in the form of windows or the like. A liquid flow closure is supported on the baffle 46 and is generally designated 53 and extends in the area of the openings 52, and, as shown in FIG. 8, and the closure 53 is a planar plate 54 which is also shown in FIG. 10 and it has its flat face 56 in flush contact with the flat face 57 of the baffle 46. As such, with the closure 54 in the FIG. 8 position of full and flush contact with the baffle face 57, there is no flow of liquid through the openings 52, and thus the baffle is in the closed position. FIG. 10 further shows that the closure 54 is in the nature of a half circle configuration, and it has openings 58 extending therethrough for respectively receiving pins 59. The pins 59 have heads 61 on the face 62 of the baffle 46, and the pins extend to another plate or baffle portion 63 which is shown in FIGS. 8 and 9. The pins 59 have reduced diametrical ends 64 and they have circular recesses 66 which receive snap rings 67 for securing the plate 63 on the pins 59. Also, the pins 59 have shoulders 68 which secure the plate 63 in the position shown in FIG. 8, and of course the plate 63 has two openings of the diametrical size of the pin ends 64 for the fixed positioning described herein.

Finally, each pin 59 has a compression spring 69 disposed thereover and extending between the plate 54 and 63 for thereby urging the plate 54 into the closed position shown in FIG. 8.

Of course it will be now seen and understood that when there is liquid flowing in the exchanger shell 14, such as in the direction of the flow arrows shown in FIG. 1, then excessive fluid pressure on the one face of the baffle 46, such as the front face viewed in FIG. 7 and the right face as viewed in FIG. 1, would cause the closure 54 to move off the baffle face 57 and thereby open the windows or openings 52 and permit the fluid to flow directly from the inlet 21 and to the outlet 22 without going through the space 27, and this would thereby eliminate excessive liquid pressure in the interior of the shell 14. That is, the closure 54 would move relative to the remainder of the baffle 46 and move between the closed position of FIG. 8 and an open position where the closure 54 would move toward the plate 63 and thereby compress the springs. Of course the springs 69 would urge the plate 54 onto the face 57 and thus to the closed position shown in FIG. 8. In that opening closing action of the movement of the baffle portion 54, as described, the pins 59 and the plate 63 are considered as guide means for guiding the bodily and planar displacement of plate 54, as described. Of course the baffle 46 is planar in configuration, such as shown in FIG. 8, and the closure 54 is movable perpendicular to the planar baffle portion 46, and the openings 52 present a fluid passageway over which the closure 54 extends for the opening and closing action described herein.

To insure the perpendicular and planar opening and closing displacement of the plate 54, the plate 54 and the pins 59 are of a non-corrosive material, such as brass, and the springs 69 are of equal force rating, all so that the closure or plate 54 will slide freely and uniformly, without cocking, on the pins 59 which are essentially arranged to remain in a fixed and true perpendicular position relative to the baffle 46. Thus, the pin heads 61 are sufficiently large in diameter to shoulder well with the baffle face 62 and thereby remain perpendicular to the baffle 46.

I claim:

1. A heat exchanger of the type having an elongated shell and a bank of tubes disposed within said shell and extending aligned with the longitudinal axis of said shell, and a baffle spanning the interior of said shell and with said tubes extending through said baffle and with said baffle having an edge spaced from said shell for the flow of liquid through the space, and a liquid inlet connector and liquid outlet connector on one side of said shell and disposed to opposite faces of said baffle for the flow of liquid around said tubes and through said space, the improvement comprising said baffle having a fluid passageway defined relative to said shell interior and being located at said one side of said shell which is located diametrically opposite said edge, a member anchored on said baffle and extending over said passageway and being movable relative to said baffle and to an opened position and only in the direction from said inlet to said outlet and only in response to fluid pressure differential acting on said member whereby there is the flow of liquid past said baffle in addition to the liquid flow through said space, and resilient means supported on said baffle and in contact with opposite ends of said member for operatively bearing upon said member to yieldingly urge said member to a closed position and against the force of said fluid pressure differential and thereby have no flow of liquid past said baffle at said member, said baffle and said member presenting an assembly extending in liquid-tight relationship with said interior of said shell when said member is in said closed position, except for the flow through said space.

2. The heat exchanger as claimed in claim 1, wherein said member is hinged with respect to said baffle for pivotal movement between said opened position and said closed position.

3. The heat exchanger as claimed in claim 2, wherein said resilient means is a torsion spring operative on said member for effecting said pivotal movement.

4. The heat exchanger as claimed in claim 1, wherein said member is disposed on said baffle at a location opposite from said edge of said baffle.

5. The heat exchanger as claimed in claim 1, wherein said liquid inlet connector and said liquid outlet connector are both on said shell at one side thereof opposite the location of said space and adjacent said member.

6. The heat exchanger as claimed in claim 5, wherein said member is hinged with respect to said baffle for pivotal movement between said opened position and said closed position, and said resilient means is a torsion spring operative on said member for effecting said pivotal movement.

7. A heat exchanger with internal fluid pressure relief means, comprising a shell having a liquid inlet and a liquid outlet with both disposed on one side of said shell, a bundle of tubes extending in said shell for the passage thereover of liquid flowing from said inlet to said outlet, a baffle disposed in said shell in the path of the liquid flowing over said tubes for the diversion of that flow and with said tubes extending through said baffle, one end of said baffle at the side of said shell opposite said one side being spaced from said shell for the flow around said baffle of the liquid flowing over said tubes, a member hingedly attached to said baffle at the location thereon adjacent said one side of said shell and being in the path of a direct line from said inlet to said outlet for movement of said member to be spaced from said shell to allow flow past said member, and a spring supported on said baffle and operative on said member for urging said member contra to its position spaced from said shell, said baffle and said member together being liquid tight with said shell, except only for said flow around said baffle, when said member is urged to said contra position, and with said member and said spring being arranged to have said member perform said movement only in response to at least a minimum magnitude of fluid pressure differential acting on said member.

8. The heat exchanger with internal fluid pressure relief means as claimed in claim 7, wherein said member is located on said baffle adjacent said one side of said shell, for the direct flow of liquid from said inlet and past said baffle and to said outlet and thereby minimize liquid pressure in said shell.

9. A heat exchanger with internal fluid pressure relief means, comprising a shell having a liquid inlet and a liquid outlet with a both disposed on one side of said shell, a bundle of tubes extending in said shell for the passage thereover of liquid flowing from said inlet to said outlet and with said tubes having a larger spacing from said shell along one portion of said shell, at said one side of said shell, as compared to other portions of said shell, a baffle disposed in said shell in the path of the liquid flowing over said tubes for the diversion of that flow and with said tubes extending through said baffle, one end of said baffle being spaced from said shell for the flow around said baffle of the liquid flowing over said tubes, a member disposed on said baffle in said larger spacing and with said baffle and said member being liquid tight with said shell except for said flow around said baffle, said member being hingedly attached to said baffle for movement of said member in said larger spacing to a position spaced from said shell and only in response to fluid pressure differential acting on said member for flow past said baffle, and a spring supported on said baffle and operative on said member for urging said member contra to its position spaced from said shell, and with said member and said spring being arranged to have said member perform said movement only in response to at least a minimum magnitude of fluid pressure differential acting on said member.

10. The heat exchanger with internal fluid pressure relief means as claimed in claim 9, wherein said member is located on said baffle adjacent said one side of said shell, for the direct flow of liquid from said inlet and past said baffle and to said outlet and thereby minimize liquid pressure in said shell.

11. A heat exchanger of the type having an elongated shell and a bank of tubes disposed within said shell and extending aligned with the longitudinal axis of said shell, and a baffle spanning the interior of said shell and with said tubes extending through said baffle and with said baffle having an edge spaced from said shell for the flow of liquid through the space, and a liquid inlet connector and a liquid outlet connector on one side of said shell and disposed to opposite faces of said baffle for the flow of liquid around said tubes and through said space, the improvement comprising said baffle having a flow passageway extending through said baffle and located at said one side of said shell which is located diametrically opposite said edge and with said baffle being in liquid tight contact with said interior of said shell except for only said edge of said baffle, a closure supported only on said baffle in a closed liquid flow position over said passageway in contact with said baffle and being movable relative to said baffle to an opened liquid flow position only in the direction from said inlet to said outlet and only in response to fluid pressure differential acting on said closure to permit the flow of liquid through said passageway in addition to the liquid flow through said space, resilient means supported on said baffle and operatively bearing upon said closure to yieldingly urge said closure to a closed position and against the force of said fluid pressure differential, and guide means mounted on said baffle and in contact with said closure for guiding the movement of said closure between the open and closed positions.

12. The heat exchanger with internal fluid pressure relief means as claimed in claim 11, wherein said passageway and said closure are located on said baffle at the edge thereof directly opposite said one edge.

13. A heat exchanger with internal fluid pressure relief means, comprising a shell having a liquid inlet and liquid outlet with both disposed on one side of said shell, a bundle of tubes extending in said shell for the passage thereover of liquid flowing from said inlet to said outlet and with said tubes having enlarged spacing from said shell along one portion of said shell as compared to other portions of said shell, a baffle disposed in said shell in the path of the liquid flowing over said tubes for the diversion of that flow and with said tubes extending through said baffle, one edge of said baffle being spaced from said shell at the location opposite said one portion for the flow around said baffle of the liquid flowing over said tubes, said baffle defining a fluid passageway in said one portion of said shell for the flow of liquid past said baffle in said enlarged spacing, a liquid flow closure supported on said baffle and disposed across said passageway and being movable relative to said baffle to a liquid flow open position relative to said passageway and in response to fluid pressure differential thereon for flow past said baffle, and two spaced-apart springs operative on said closure for urging said closure contra to said open position and thereby into closed position.

14. The heat exchanger as claimed in claim 13, wherein said baffle is planar in shape, and said closure is a plate wholly movable perpendicular with respect to the plane of said baffle and into and out of contact with said baffle for movement between said open position and said closed position.

15. The heat exchanger as claimed in claim 13, wherein said liquid inlet connector and said liquid outlet connector are both on said shell at one side thereof adjacent said closure and opposite the location of the space at said one edge of said baffle.

16. The heat exchanger with internal fluid pressure relief means as claimed in claim 15, wherein said closure is located on said baffle adjacent said one side of said shell, for the direct flow of liquid from said inlet and past said baffle and to said outlet and thereby minimize liquid pressure in said shell.

17. The heat exchanger with internal fluid pressure relief means as claimed in claim 16, wherein said baffle fluid passageway is located on a direct line between said inlet and said outlet for the flow of fluid therethrough, and said closure extends over said fluid passageway in the closed position and perpendicular to said line.

18. The heat exchanger with internal fluid pressure relief means as claimed in claim 17, including two guide posts extending between said closure and said baffle for guided movement of said closure, and said two springs being on respective ones of said posts for urging said closure closed.

19. The heat exchanger with internal fluid pressure relief means as claimed in claim 13, including two guide posts extending between said closure and said baffle for guided movement of said closure, and said two springs being on respective ones of said posts for urging said closure closed.

* * * * *